United States Patent [19]

Wegerdt et al.

[11] 4,352,319

[45] Oct. 5, 1982

[54] POSITIVE CONTROL FOR HYDROSTATIC MOTORS, ESPECIALLY RADIAL PISTON MOTORS

[76] Inventors: Fritz Wegerdt, Wagnerstr. 26, 7987 Weingarten; Kurt Woelk, Mainzer Str. 121, 5300 Bonn-Bad Godesberg, both of Fed. Rep. of Germany

[21] Appl. No.: 67,455

[22] Filed: Aug. 17, 1979

[51] Int. Cl.[3] ..... F01B 1/06

[52] U.S. Cl. ..... 91/483; 91/492

[58] Field of Search ..... 91/480, 481, 483

[56] References Cited

FOREIGN PATENT DOCUMENTS

| | | | |
|---|---|---|---|
| 1926597 | 10/1970 | Fed. Rep. of Germany | 91/480 |
| 2251778 | 5/1974 | Fed. Rep. of Germany | 91/481 |
| 2413955 | 10/1975 | Fed. Rep. of Germany | 91/480 |
| 534582 | 7/1975 | U.S.S.R. | 91/481 |
| 659781 | 4/1979 | U.S.S.R. | 91/481 |

*Primary Examiner*—William L. Freeh

*Attorney, Agent, or Firm*—Whittemore, Hulbert & Belknap

[57] ABSTRACT

The invention relates to a positive control especially radial piston motors for hydrostatic motors. Such control, while permitting a large range of rotational speed, is capable of avoiding disturbances in the oil flow occurring during coverage of the edges of includes slide valves and provides optimum smoothness of operation of the hydrostatic drive. It is the object of each slide valve to control the connection between an associated working cylinder and the inflow and outflow of the pressure medium. It is a further object of the slide valve to establish connection between the associated working cylinder and a pressure equalizing conduit, at least during coverage of a first pair of control edges, i.e. in a phase during which the working cylinder is cut off both from the pressure medium intake and from the pressure medium outlet. For this purpose the slide valve is provided with a second pair of control edges. The arrangement is such that two cylinder spaces each with oppositely moving working pistons are short-circuited via a pressure equalizing channel common to all equalizing conduits, particularly when the number of working cylinders arranged in a ring around the rotational axis is uneven. During normal operation the drive for the slide valve and the drive for the working piston are offset in circumferential direction one with respect to the other by about 90°.

25 Claims, 4 Drawing Figures

POSITIVE CONTROL FOR HYDROSTATIC MOTORS, ESPECIALLY RADIAL PISTON MOTORS

Figure 1:
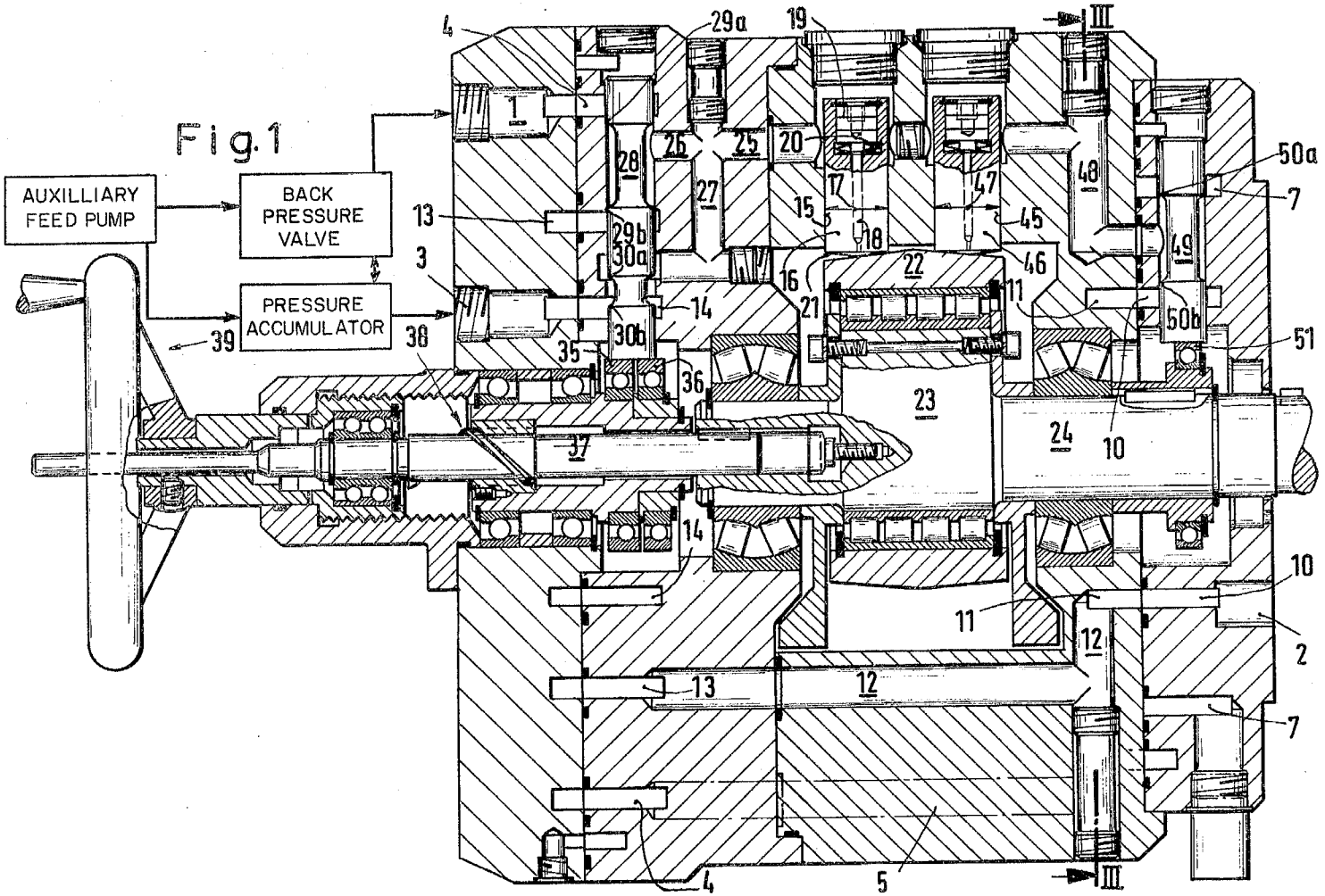

It is an object of the present invention to so improve the operational principle of the positive control that, when used as a motor, a substantially improved synchronism combined with high output rates or high rotational speeds and a wide range of speed variation are attained. This problem is solved in that a second ring of fixedly arranged working cylinders is provided. Each working cylinder of said second ring is likewise associated with a slide valve. But this slide valve is provided with only one pair of control edges for controlling the connection of the associated working cylinder with the pressure medium intake or pressure medium outlet, respectively. The slide valves of the second set of working cylinders are connected with the motor shaft via an eccentric which is likewise phase-displaced relative to the eccentric of the working pistons, but at an invariable, constant phase angle. Here, too, the pressure medium pump supplies the pressure medium to the hydrostatic motor under constant pressure and at constant volumetric output rates. The absorbing capacity of the working cylinders of each ring of cylinders remains invariably the same during operation. By the variable phase difference between the slide valves and the associated working cylinders of the first set of working cylinders it is possible to short-circuit a variable oil flow within the hydrostatic motor. The control range resides between the maximum torque at minimum speed, at which the volume of both rings of working cylinders are utilized for driving the motor shaft, and the minimum torque at maximum speed, where only the difference of the two volume have a driving effect on the motor shaft. In this connection it is of importance that independently of the phase difference there remains always a residual torque in the range of the first ring of working cylinders, as otherwise a reliable control of the motor and the smooth operation thereof cannot or can only insufficiently be provided. In the respective embodiment of the positive control the residual torque is obtained in that the working cylinders of the two rings of working cylinders have a markedly different diameter, so that independently of the phase adjustment there remains always a residual volume determining the torque. By the firm adjustment of the diameter ratio of the working cylinders of the two rings there is determined not only the residual torque, but also the maximum change in the speed ratio of the hydrostatic motor by varying the phase relation between the working piston of the first ring of working cylinders and the associated slide valves.

Now, it may occur that the designated residual torque does not suffice for overcoming the potential resistances acting against the motor. Furthermore, differential conduit bores within the motor housing may also cause flow resistances in the intake and discharge conduits for the two cylinder rings, which are likely to interfere with the predetermined residual torque by differential pressure drop. On the other hand, it may also occur that the control range for the rotational speed of for instance a speed ratio of 1:25 does not suffice for certain purposes, so that a positive drive according to the earlier application calls for the interconnection of a switch gear between the hydrostatic motor and the device driven by the same, thus increasing expenditure, evoking danger of inadmissible play in the driving path and resulting in noises no longer tolerable in present days.

It, therefore, is another object of the present invention to so improve the new positive control as to avoid the indicated shortcomings and to offer at the same time a simple possibility of increasing the residual torque, while the speed control range remains constant, or of substantially increasing the speed control range without running the risk of overspeeding the motor or exhausting the torque at the high speeds, respectively.

In this arrangement a predetermined differential working pressure is applied to the two sets of slide valves.

Also in this embodiment the diameters of the working cylinders of the two rings of working cylinders may be slightly or appreciably different. In such case, it is true, one does not obtain an extension of the speed range, but it is possible by the described measures to vary the residual torque within essential limits so that, when a higher residual torque is desired, such higher torque can be adjusted without subjecting the hydrostatic motor to any change, solely by simple manipulations to be performed on the positive control.

Preferably, the cross-sectional widths of the working cylinders of both rings of working cylinders are equal. In this case a limitation of the speed range necessarily resulting from the difference in diameters does no longer exist. Theoretically, the speed could be varied in a ratio of one to infinity. In practice, however, an upper limit is set to the speed by mechanical conditions. Notwithstanding the higher speed range, the new measures will reliably ensure a predetermined torque, so that the hydrostatic motor is capable of reliable operation also at greatly increased speeds. By virtue of the new positive control a hydrostatic motor can be employed also in those cases where up to the present an additional mechanical switch gear or other additional auxiliary devices increasing the speed range were required.

Same as is the case with the positive control according to the first embodiment, the uncovering of the working cylinder to permit communication with the pressure equalizing conduit takes place mainly in the region of coverage of the control edge controlling connection with the pressure medium intake or pressure medium outlet, respectively. Since for this purpose only small gaps are at disposal for penetration of the pressure medium between working cylinder and pressure equalizing conduit or between the latter and another working cylinder, respectively, the throttling effect conditioned thereby not only results in a rise in temperature of the pressure medium, but provokes also an increased preliminary pressure, which is undesirable as it reduces the output rate. It is a third object of the present invention to remove this handicap. To this end, the respective slots are doubled or multiplied in that the respective connecting channels to the working cylinder or to the pressure equalizing conduit open each at the side of the respective slide valve into two or more parallel slots defined between control edges, so that in this area the throttling effect is substantially reduced, thereby rendering the rise in pressure and temperature of the pressure medium caused by the remaining throttling effect negligibly small.

In some cases it may also be advantageous to mechanically split the drive of the two sets of working pistons and to provide two separate eccentrics or the like variable as to the relative phase position. The change of the phase position may also be mechanically adjustable in a way similar to that of the slide valves of the one set. But there may also be provided an automatic adjustment effective as a function of the torque, for instance by using a torsional connection between the eccentric of the one set of working pistons and the eccentric of the associated set of valve slides.

In the claims and in the specification reference is always made to slide valves for controlling the pressure medium flow and the equalizing channel. if desired, instead of slide valves there may also be provided other known control systems, such as slot control or face plate control or the like, without changing the fundamental aspects of the invention. However, in view of the desired adjustability of the speed toward high speed values, as a rule, slide valves in connection with the indicated measures according to the present invention are preferred.

There may also be provided more than two rings of working cylinders arranged also in different motor housings.

Figure 3:
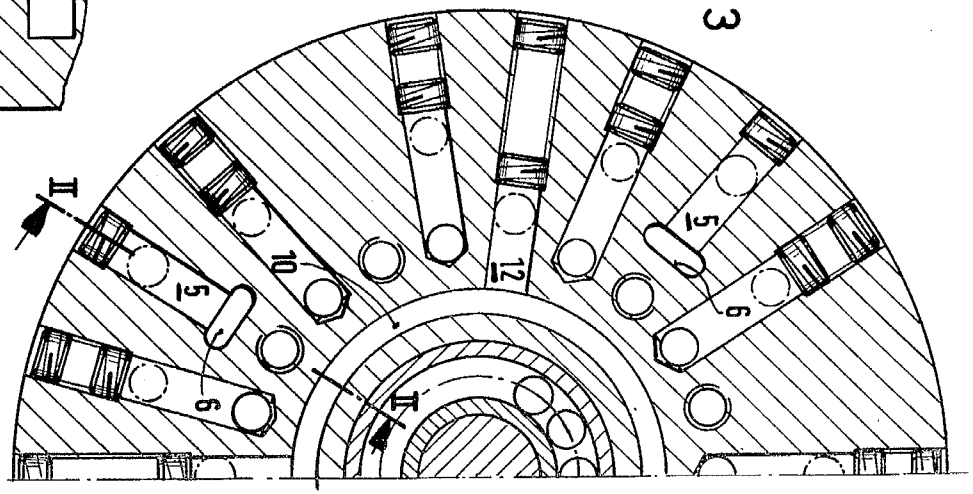
Figure 2:
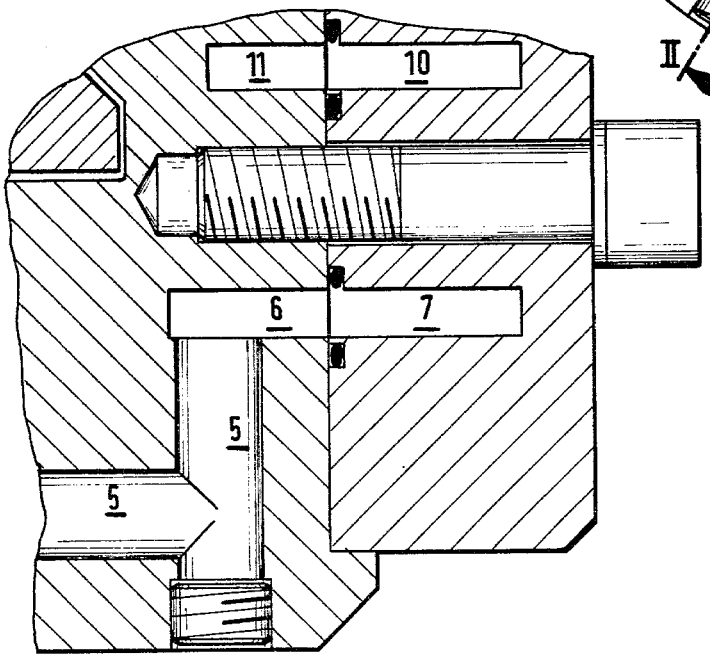

In the following the invention is explained in detail in conjunction with schematic drawings applied to two exemplified embodiments, in which FIG. 1 shows a vertical section through a hydrostatic radial piston motor;

FIG. 2 exhibits a section along the line II—II of FIG. 3;

FIG. 3 a transverse section along the line III—III of FIG. 1 and

Figure 4:
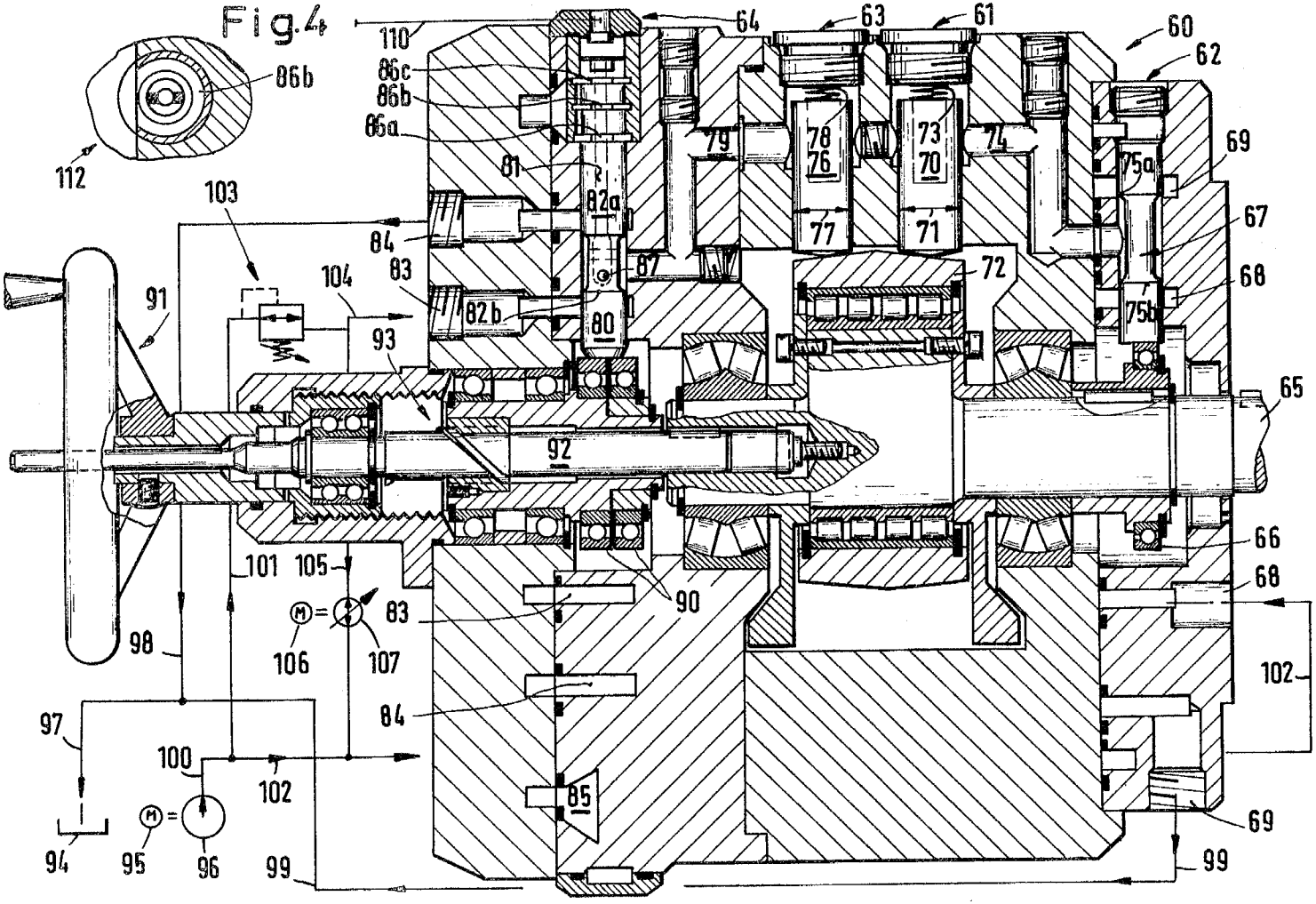

FIG. 4 shows a representation similar to that of FIG. 1 of a modified embodiment.

Essential portions of the illustrated radial piston motor, so far, are known. The following description is therefore restricted to the features necessary for an understanding of the further development.

Reference numerals 1 and 2 designate the inlet and outlet of the hydraulic fluid circulation, with the inlet and outlet being exchangeable. At 3 an outer connection for the common equalizing conduit 14 is provided. In some cases, the outer connection 3 for the equalizing conduit may be connected with a pressure accumulator capable of compensating any remaining pressure fluctuations in the equalizing conduit. The pressure accumulator may be fed with the necessary continuous pressure by a hydraulic auxiliary feed pump. This auxiliary pump may also be connected with the working pressure channel via a back pressure valve opening toward the working pressure channel, by which measure it is ensured that the pressure in the accumulator does not exceed the pressure in the working pressure channel.

As usual, the motor housing is composed of several portions and is provided with a plurality of annular channels and with a plurality of axial channels disposed in various planes.

The following description is based on the assumption that the connection 1 is provided for the pressure oil and the connection 2 for the return oil.

The connection 1 opens into an annular channel 4 which, as shown by FIGS. 1 to 3, via a plurality of circumferentially distributed exterior bores 5, is in free communication with another annular channel 6, 7 at the other end of the motor housing. Hence, the same hydraulic feed pressure prevails in the annular channels 4 and 7.

The outlet 2 opens into an annular channel 10, 11, which via radial external bores 12, opens into an annular channel 13 at the end comprising the inlet 1. If in the container channel a back-pressure valve producing a predetermined pressure is arranged, the same container pressure prevails constantly in the annular channels 10 and 13.

The annular channels 4 and 13 respectively 7 and 10 are concentrically arranged in radially spaced apart relationship. On the left hand or intake side of the motor a further annular channel 14 is concentrically arranged within the two annular channels 4 and 13 in radially spaced relationship.

In the median portion of the longitudinal section of the stationary motor housing there is provided a ring of radial bores equidistantly spaced along the circumference and forming first working cylinder spaces 15. In each working cylinder space 15 a working piston 16 moves in radial direction, of which the diameter is indicated at 17. The radially inner end 21 of each working piston 16 drivingly cooperates via a drive connection 22, 23 with the motor shaft 24. The radially outer end of each working piston opens into a widened portion of the working cylinder which, via a bore 25, 26, opens into an associated radial bore equally penetrating the concentrically arranged annular channels 4, 13 and 14 at the intake side of the motor. In said bore a slide valve 28 is moving. Each slide valve 28 is provided with two radially spaced-apart cooperating pairs of control edges **29*a*, 29*b* and 30*a*, 30*b*, respectively. The pair of control edges 29*a*, 29*b* controls the connection between the bore 25, 26 of the associated working cylinder and the annular channels 4, 13 assigned to the intake or outlet respectively. The bore 25, 26 is provided with a branch bore 27 opening between the annular channels 13 and 14 on the associated slide valve 28 in such manner that the connection of said branch bore 27 with the annular channel 14 can be controlled by the second pair of control edges 30*a*, 30*b*** of the slide valve.

The number of slide valves 28 is equal to the number of working pistons 16. For a working cylinder ring composed of eleven working pistons eleven slide valves 28 are correspondingly provided.

The radially outer end of each slide valve opens into a collecting channel for overflow oil, whilst the radially inner end of each slide valve cooperates simultaneously with two juxtapositioned ring-shaped outer races 35, 36 of ball bearings eccentrically arranged relative to the shaft 37. The centers of the two eccentrics 35 and 36 are offset one with respect to the other by a predetermined angular distance of for instance 4°. This angle may for instance by equal to half the divisional angle between the slide valves equidistantly arranged in circumferential direction. Hence, each slide valve 28 is acted upon by an eccentric path of non-circular shape, though each of the two eccentric rings 35 and 36 as such is circular in shape. The deviation from circular shape is such that, independently of the relative phase position of the drive for the slide valve 28 and of the drive 22, 23 for the working pistons 16, two slide valves 28 each performing opposite movements reach the coverage position of their first pairs of control edges **29*a* and 29*b* simultaneously (see FIG. 1). In this position the pairs of control edges 30*a* and 30*b* of the two oppositely moving slide valves 28 referred to expose the connection between the branch bore 27 and the annular pressure equalizing conduit 14 common to all slide valves 28, so that in this phase the working cylinder spaces of the working pistons 16 assigned to the two slide valves 28 referred to are in free flow communication with the common pressure equalizing conduit 14, thus permitting free pressure balance between said working cylinder spaces. This results in an oil balance within the motor between working cylinders acted upon in opposite directions in certain phases of the rotary movement. The phase region in which this internal balance takes place can be varied. For this purpose, the eccenter jointly carrying the two ball bearings 35, 36 can be tilted relative to the shaft 37 via the adjustable connection 38, when the shaft 37, which is fixedly connected with the motor shaft 24 and the working eccentric 23 thereof, is shifted by the adjusting means 39 in axial direction relative to the motor shaft 24**. The range of phase displacement is not limited.

The two concentric annular channels 7 and 10 on the other end of the motor housing are crossed by a plurality of radial bores equidistantly spaced along the circumference, which bores are associated with a further slide valve 49 each. But each slide valve 49 is provided with one pair of control edges 50*a*, 50*b* only. The radially outer end of the slide valve opens into a collecting channel for overflow oil, whilst the radially inner end is supported on a circular ball bearing 51 which in turn is arranged on an eccentric fixedly secured to the motor shaft 24. A connecting bore 48 proceeding from a further working cylinder 45 opens into the radial bore of each slide valve 49. A plurality of working cylinders 45 are in a crownlike manner arranged about the axis of the motor shaft 24. The number of working cylinders 45 of said second ring of cylinders is the same as the number of working cylinders 15 of the first ring of cylinders. A working piston 46 moves in each working cylinder 45. The diameter 47 of said working piston 46 is larger by a predetermined small magnitude than the diameter 17 of the working piston 16 of the first ring of working cylinders. The radially inner end of the working cylinders 46 is supported on the same ball race 22 of the drive connection 22, 23 of the motor shaft 24 as is the radially inner end 21 of the working pistons 16 of the first ring of cylinders. Hence, the arrangement can be to the effect that two working pistons 16 and 46 of the two rings execute strictly synchronous movements. As compared to the eccentric position of the drive connection 22, 23 the eccentric position of the drive for the slide valve 49 shows an invarable constant phase relation of preferably 90°. This means that coverage as shown in FIG. 1 of the control edges 50*a* and 50*b* of the slide valves 49 in both stroke directions is then reached when the associated working piston 46 moves through the upper and lower dead point, respectively. While passage through the dead point position takes place at a low speed of the working pistons 46, the slide valves 49 pass the coverage position shown in FIG. 1 at maximum linear velocity.

Hence, the working cylinders 45 have maximum absorption capacity in any adjusted operational position as regards the pressure oil flowing under constant pressure. If the setting of the adjusting means 38, 39 for the drive of the slide valves 28 is such that also the drive 35, 36 shows a plane displacement of about 90° relative to the drive connection 22, 23 of the working pistons, then also the working cylinders 15 of the first ring of cylinders attain maximum absorbing capacity, the absorbing capacity of the first ring of cylinders being altogether smaller than that of the second ring of cylinders due to the differential diameters of the respective cylinder spaces. As in the latter cylinder spaces the prevailing oil pressure is the same as in the cylinder spaces of the first ring, the motor in this position arrives at maximum torque and minimum speed.

The speed of the motor can without difficulty be varied for instance in a ratio of 1:25 by the adjustment of the phase position by the adjusting means 38, 39. With increasing phase variation between the drive 35, 36 and the drive connection 22, 23 the operative portion of the pressure oil received by the first ring of cylinders decreases in that an increasing pressure oil exchange between two oppositely moving working cylinders takes place. This will reduce the torque, while the speed increases. The phase displacement may be to the effect that the other extreme value of the control region can be represented by the difference of the maximum absorption volumina of the two rings of working cylinders.

Expediently, all working pistons are provided with a recess in the end exposed to the working pressure, in which recess a piston 19 is slidably guided, which by a prestressing means, for instance by the plate package 20, can be prestressed at a predetermined pressure to assume the radially outer position as shown in FIG. 1. Small pressure rises, that may occur during operation, can in a simple way be compensated by deflection of the piston 19 radially inwardly. Furthermore, provisions are made that a small amount of overflow oil emanates through the piston bores 18 for lubrication in the region of the drive connection 21, 22, 23.

The radial piston motor as illustrated in FIG. 4 has a multipart housing 60 comprising two sets of working cylinders 61 and 63, respectively, arranged in a ring. The set 61 of working cylinders is associated with a set of slide valves 67 likewise arranged in a ring, whilst the other set 63 of working cylinders is associated with another set 64 of slide valves 81.

To the working pistons 70 and 76, respectively, there is assigned a common eccentric ring 72 which, via roller bearings, is freely rotatably mounted on an eccentric section of the motor shaft 65. To the motor shaft 65 there is fixedly connected a further eccentric 66, which is engaged by the inner ends of the slide valves 67 of the one set 62 of slide valves. As regards the eccentricity of the eccentric 72 and the eccentric ring 66, they show a predetermined definitely adjusted phase displacement such, that when the working piston 70 passes through one of its two dead point positions, the associated slide valve 67 reaches its central position, as illustrated in the figure.

Each slide valve 67 has a single pair of control edges 75*a*, 75*b*, by which the connection 74 with the associated working cylinder relative to the pressure medium intake 68 and the pressure medium outlet 69 is controlled.

In the illustrated example the working pistons are held in contact with the eccentric ring 72 by pressure springs 73 and 78, respectively.

The ring 61 of working cylinders with the associated ring of slide valves is separated from the ring 63 of working cylinders and the associated ring 64 of slide valves within the motor as regards the pressure medium. There are thus formed within the motor drive systems which are independent one from the other. As regards the driving effect on the motor shaft 65, said systems are forcibly coupled with each other by the common eccentric ring 72 for the working pistons 70 and 76 of the two rings 61 and 63 of working cylinders. But there may also be provided a separate eccentric ring 72 for each ring 61 or 63, respectively, of working cylinders, so that both rings of working pistons act independently on the same shaft. In such case, the two eccentric rings and, hence, the mode of operation of the two rings of working pistons may also be phase-displaced one with respect to the other. However, the embodiment depicted in the figure is preferred.

The working cylinders of the ring 63 of working cylinders are connected each via a pressure medium bore with the bore wherein the associated slide valve 81 moves. With their radial inner end 80 all slide valves of the ring 64 of slide valves abut on a common eccentric 90 of non-circular shape, which via an adjusting means, for instance the wheel 91 and an adjusting shaft 92 with a worm thread 93, can within wide limits be varied in the relative phase position with respect to the eccentric ring 72 of the motor shaft, also while the motor operates.

The slide valves 81 control the connection of the channel 79 with the pressure medium intake 83 or the pressure medium outlet 84, respectively. For this purpose each slide valve 81 is provided with a first pair of control edges 82*a* and 82*b*, which in the illustrated drawing assumes just the position where it separates the associated working cylinder both from intake and outlet.

Between the control edges 82*a* and 82*b* each slide valve 81 is provided with one or a plurality of radial bores 87 which end in an axial bore of the slide valve indicated by dashed lines. Said bore leads radially outward in the direction of the axis of the slide valve 81 and, outside of the pressure medium outlet 84, is in flow connection with a plurality (three being indicated in the illustrated example) of circumferentially arranged control grooves 86*a*, 86*b* and 86*c*. Each control groove of the slide forms a pair of control edges, which in the illustrated position is in alignment with control slots of a bushing inserted into the housing part. In turn, the control slots in the bushing are in free communication with a pressure medium 85 common to all slide valves 81. Despite the small dimensions of the flow connection between the pressure equalizing channel 85 and the axial bore of the slide valve 81, which is in constant free communication with the flow channel 79, the connection in parallel of the slide grooves 86*a* to 86*c* and of the associated housing slots permit to uncover sufficient cross-sectional spaces in predetermined positions of said slide valve to ensure without an appreciable rise in temperature of the pressure medium and without building up a disturbing reaction pressure or throttle pressure a reliable and precise control of the connection between the bores 79 leading to the working cylinders and their common pressure equalizing channel 85. At 112 there is shown a section vertical to the axis of the slide 81 at the level of the central annular groove 86*b*.

The two pressure medium systems within the motor are associated with a common pump 94 for the recycled pressure medium and with a common pressure medium source in the form of a pump 96 preferably driven at constant speed and constant volumetric output by the motor 95. The two pressure medium outlets 69 and 84, respectively, are connected each with the common pump channel 97 over return conduits 99. The pressure pipe 100 of the pump 96 is branched off to form two pressure medium channels 101 and 102. The branch channel 102 is directly connected with the pressure medium intake 68 at the right hand side of the motor. The pressure medium branch channel 101 ends in an adjustable pressure reducing means 103 of known construction. The outlet conduit 104 of the pressure reducing means 103 is connected to the pressure medium intake 83 at the left hand side of the motor. In this way, the pressure medium is fed to the working cylinders of the two rings 61 and 63, respectively, with a predetermined adjustable pressure difference, the pressure medium destined for the working cylinders of the ring 61 being fed at a predetermined higher pressure. In order to obtain a volumetric balance between the pressure medium connection 83 and the pressure medium intake 68 of the two systems, a junction channel 105 is connected to the outlet conduit 104 of the pressure reducing means 103, which is blown through in the direction of the arrow toward the other pressure medium branch channel 102. Before the connection of the junction channel to the pressure medium branch channel 102 there is provided a means for raising the working pressure of the pressure medium emanating through the junction channel to the working pressure prevailing in the pressure pipe 100. This means is provided in the form of a drive motor 106 and a small pump 107 for the pressure medium, preferably with variable speed and/or volumetric output rates. There is thus provided between the two pressure medium systems the possibility of a volumetric balance, which is necessary when the relative phase position of the slide valves 81 is varied during operation of the motor relative to the associated working pistons 76, so that connection between the associated working cylinders and the pressure equalizing conduit 85 is established not only when the working pistons 76 pass the deadpoint.

The adjustable pressure difference at the pressure feed sides of the two systems permits varying the residual torque at a maximum speed of the motor, especially when the working pistons 70 and 76 of the two sets 61 and 63, respectively, of the working cylinders have different diameters 71 and 77. Preferably, however, the diameters of the working pistons 70 and 76 of the rings 61 and 63 are identical. This permits to further extension of the speed range to arrive at substantially higher rotational speeds than could be attained with a constant diameter difference of the working pistons of the two rings. The necessary residual torque or minimum torque at maximum speed with equal diameters of the working pistons is then controlled solely by the adjustment of the differential pressure on the pressure input sides 68 and 83.

As initially referred to, the eccentric ring 72 for the two crowns 61 and 63 may be split into two independent eccentrics. In such case, the eccentric assigned to the set 61 remains in fixed phase displacement relative to the eccentric ring 66 of the control pistons 67, while the eccentric ring of the set 63 can in this case be circumferentially adjusted. To this end, the adjusting shaft 92 can be designed in the form of a torsion shaft and can be provided with a screw thread according to the screw thread 93 both for the eccentric 90 and for the eccentric assigned to the ring 63. In this case the arrangement may be such that a relative torsion of the control shaft 92 takes place as a function of the respective torque. This may be expedient for certain operational purposes.

The slide valves 81 are held in radial contact with the eccentric 90 by a preliminary pressure which may be applied for instance on the closed outer front end of the slide valve via the conduit 110.

We claim:

1. A positive control for hydrostatic motors, especially radial piston motors, comprising two sets of working cylinders distributed in a ring-like manner each in a stationary housing part with two sets of working pistons moving therein and acting via eccentric or like drive connections on the motor shaft and two sets of slide valves, the slide valves of the one set being associated each with a working cylinder of the one set and provided with a single pair of control edges for controlling the connection of the associated working cylinder with the pressure medium intake and the pressure medium outlet and with a common actuating eccentric which, relative to the eccentric of the working pistons, is arranged in fixed phase-displaced relation on the motor shaft, whilst the slide valves associated with the other set of working cylinders of the second set of slide valves, in addition to a first pair of control edges controlling the connection of the associated working cylinder with the pressure medium intake, have also a second pair of control edges for connecting the associated working cylinder at least during coverage of the first pair of control edges with a pressure equalizing conduit, all of said pressure equalizing conduits being in constant free flow communication with a common pressure equalizing channel and the phase relation between the eccentric of the working pistons and a driving eccentric actuating the slide valves of the second set of slide valves being adjustable during operation of the motor, the arrangement being such that with any setting of the phase relation a predetermined torque is maintained, the positive control being further characterized in that when the pressure medium intakes and the pressure medium outlets of the two sets of slide valves are separated one from the other, the pressure medium intakes are arranged in parallel and via forced conduits are connected with a common pressure source that in the branch conduit leading to the intake of the slide valves having two pairs of control edges there are provided a pressure reducing means and downstream of the same a junction channel leading to the other branch channel in which junction channel there is arranged a device elevating the pressure of the pressure medium emanating from the junction channel to the working pressure of the pressure medium source.

2. A positive control as claimed in claim 1, characterized in that the working pistons (70, 76) of both sets of working cylinders have the same or, at the most, a very slightly differing diameter.

3. A positive control as claimed in claim 1, characterized in that as drive for the slide valves (28) comprising two pairs of control edges (29*a*, 29*b* and 30*a*, 30*b*) an eccenter composed of two circular eccenter sections (35, 36) is provided, the eccentric centers of the same being offset relative to the rotational axis by a predetermined angular distance.

4. A positive control as claimed in claim 1, characterized in that the pressure equalizing conduit or the connection to the associated working cylinder, respectively, at the side of the associated slide valve ends in two or more parallel slots (86*a* to 86*c*) between housing edges or slide valve edges, respectively.

5. A positive control as claimed in claim 4, characterized in that the eccentric serving as the drive for the slide valves of the second ring of cylinders is fixedly connected with the motor shaft.

6. A positive control as claimed in claim 4, characterized in that the pressure equalizing conduit is connected with a pressure accumulator which, in turn, is connected with the working pressure conduit via a back pressure valve.

7. A position control as claimed in claim 4, characterized in that as drive for the slide valves comprising two pairs of control edges and eccentric composed of two circular eccentric sections is provided, the eccentric centers of the same being offset relative to the rotational axis by a predetermined angular distance.

8. A positive control as claimed in claim 1, characterized in that the eccentric serving as the drive for the slide valves (49) of the second ring of cylinders is fixedly connected with the motor shaft (24).

9. A positive control as claimed in claim 8, characterized in that the pressure equalizing conduit is connected with a pressure accumulator which, in turn, is connected with the working pressure conduit via a back pressure valve.

10. A positive control as claimed in claim 8, characterized in that as drive for the slide valves comprising two pairs of control edges an eccentric composed of two circular eccentric sections is provided, the eccentric centers of the same being offset relative to the rotational axis by a predetermined angular distance.

11. A positive control is claimed in claim 1, characterized in that the pressure equalizing conduit is connected with a pressure accumulator which, in turn, is connected with the working pressure conduit via a back pressure valve.

12. A positive control as claimed in claim 11, characterized in that as drive for the slide valves comprising two pairs of control edges an eccentric composed of two circular eccentric sections is provided, the eccentric centers of the same being offset relative to the rotational axis by a predetermined angular distance.

13. A positive control for hydrostatic motors, especially radial piston motors, comprising two sets of working cylinders distributed in a ring-like manner each in a stationary housing part with two sets of working pistons moving therein and acting via eccentric or like drive connections on the motor shaft and two sets of slide valves, the slide valves of the one set being associated each with a working cylinder of the one set and provided with a single pair of control edges for controlling the connection of the associated working cylinder with the pressure medium intake and the pressure medium outlet and with a common actuating eccentric which, relative to the eccentric of the working pistons, is arranged in fixed phase-displaced relation on the motor shaft, whilst the slide valves associated with the other set of working cylinders of the second set of slide valves, in addition to a first pair of control edges controlling the connection of the associated working cylinder with the pressure medium intake, have also a second pair of control edges for connecting the associated working cylinder at least during coverage of the first pair of control edges with a pressure equalizing conduit, all of said pressure equalizing conduits being in constant free flow communication with a common pressure equalizing channel and the phase relation between the eccentric of the working pistons and a driving eccentric actuating the slide valves of the second set of slide valves being adjustable during operation of the motor, the arrangement being such that with any setting of the phase relation a predetermined torque is maintained, characterized in that the pressure equalizing conduit or the connection to the associated working cylinder, respectively, at the side of the associated slide valve ends in two or more parallel slots between housing edges or slide valve edges, respectively.

14. A position control as claimed in claim 13, characterized in that as drive for the slide valves comprising two pairs of control edges and eccentric composed of two circular eccentric sections is provided, the eccentric centers of the same being offset relative to the rotational axis by a predetermined angular distance.

15. A positive control as claimed in claim 13, characterized in that the eccentric serving as the drive for the slide valves of the second ring of cylinders is fixedly connect with the motor shaft.

16. A postive control as claimed in claim 15, characterized in that the pressure equalizing conduit is connected with a pressure accumulator which, in turn, is connected with the working pressure conduit via a back pressure valve.

17. A position control as claimed in claim 15, characterized in that as drive for the slide valves comprising two pairs of control edges and eccentric composed of two circular eccentric sections is provided, the eccentric centers of the same being offset relative to the rotational axis by a predetermined angular distance.

18. A positive control as claimed in claim 13, characterized in that the pressure equalizing conduit is connected with a pressure accumulator which, in turn, is connected with the working pressure conduit via a back pressure valve.

19. A position control as claimed in claim 18, characterized in that as drive for the slide valves comprising two pairs of control edges and eccentric composed of two circular eccentric sections is provided, the eccentric centers of the same being offset relative to the rotational axis by a predetermined angular distance.

20. A positive control for hydrostatic motors, especially radial piston motors, comprising two sets of working cylinders distributed in a ring-like manner each in a stationary housing part with two sets of working pistons moving therein and acting via eccentric or like drive connections on the motor shaft and two sets of slide valves, the slide valves of the one set being associated each with a working cylinder of the one set and provided with a single pair of control edges for controlling the connection of the associated working cylinder with the pressure medium intake and the pressure medium outlet and with a common actuating eccentric which, relative to the eccentric of the working pistons, is arranged in fixed phase-displaced relation on the motor shaft, whilst the slide valves associated with the other set of working cylinders of the second set of slide valves, in addition to a first pair of control edges controlling the connection of the asociated working cylinder with the pressure medium intake, have also a second pair of control edges for connecting the associated working cylinder at least during coverage of the first pair of control edges with a pressure equalizing conduit, all of said pressure equalizing conduits being in contact free flow communication with a common pressure equalizing channel and the phase relation between the eccentric of the working pistons and a driving eccentric actuating the slide valves of the second set of slide valves being adjustable during operation of the motor, the arrangement being such that with any setting of the phase relation a predetermined torque is maintained, characterized in that the further working pistons, in the second set of pistons have a cross-sectional width exceeding the cross-sectional width of the working cylinders in the first set of pistons and that the front face of each working piston exposed to the working pressure has a front wall portion yielding under a predetermined prestressing.

21. A positive control as claimed in claim 20 characterized in that the two rings of cylinders comprise the same number of cylinders and that the same hydraulic input pressure is constantly applied to the control edges of the slide valves (28 and 49, respectively).

22. A positive control as claimed in claim 20, characterized in that the working pistons (16 and 46) of different diameter of the two rings of working cylinders are provided with a common drive connection (22, 23) to the motor shaft (24).

23. A positive control as claimed in claim 22, characterized in that the two rings of cylinders comprise the same number of cylinders and that the same hydraulic input pressure is constantly applied to the control edges of the slide valves.

24. A positive control for hydrostatic motors, especially radial piston motors, comprising two sets of working cylinders districuted in a ring-like manner each in a stationary housing part with two sets of working pistons moving therein and acting via eccentric or like drive connections on the motor shaft and two sets of slide valves, the slide valves of the one set being associated each with a working cylinder of the one set and provided with a single pair of control edges for controlling the connection of the associated working cylinder with the pressure medium intake and the pressure medium outlet and with a common actuating eccentric which, relative to the eccentric of the working pistons, is arranged in fixed phase-displaced relation on the motor shaft, whilst the slide valves associated with the other set of working cylinders of the second set of slide valves, in addition to a first pair of control edges controlling the connection of the associated working cylinder with the pressure medium intake, have also a second pair of control edges for connecting the associated working cylinder at least during coverage of the first pair of control edges with a pressure equalizing conduit, all of said pressure equalizing conduits being in constant free flow communication with a common pressure equalizing channel and the phase relation between the eccentric of the working pistons and a driving eccentric actuating the slide valves of the second set of slide valves being adjustable during operation of the motor, the arrangement being such that with any setting of the phase relation a predetermined torque is maintained, characterized in that the pressure equalizing conduit is connected with a pressure accumulator which, in turn, is connected with the working pressure conduit via a back pressure valve.

25. A position control as claimed in claim 24, characterized in that as drive for the slide valves comprising two pairs of control edges and eccentric composed of two circular eccentric sections is provided, the eccentric centers of the same being offset relative to the rotational axis by a predetermined angular distance.

* * * * *